US006308507B1

(12) United States Patent
Dinkelmann

(10) Patent No.: US 6,308,507 B1
(45) Date of Patent: Oct. 30, 2001

(54) METHOD OF AND APPARATUS FOR PRODUCING A TEXTILE YARN

(75) Inventor: Friedrich Dinkelmann, Rechberghausen (DE)

(73) Assignee: Zinser Textilmaschinen GmbH, Ebersbach/Fils (DE)

( * ) Notice: Subject to any disclaimer, the term of this patent is extended or adjusted under 35 U.S.C. 154(b) by 0 days.

(21) Appl. No.: 09/099,359

(22) Filed: Jun. 18, 1998

(30) Foreign Application Priority Data

Jun. 28, 1997 (DE) ..... 197 27 575

(51) Int. Cl.[7] ..... D01H 4/00

(52) U.S. Cl. ..... 57/75; 57/328; 57/400; 57/401; 57/408; 57/411

(58) Field of Search ..... 57/75, 328, 400, 57/401, 408, 411

(56) References Cited

U.S. PATENT DOCUMENTS

| | | | | |
|---|---|---|---|---|
| 4,237,685 | | 12/1980 | Pelagio | 57/328 |
| 4,574,582 | * | 3/1986 | Derichs | 57/401 |
| 4,676,062 | * | 6/1987 | Brockmanns et al. | 57/400 |
| 5,157,911 | * | 10/1992 | Stahlecker et al. | 57/328 |
| 5,187,930 | * | 2/1993 | Stahlecker | 57/400 |
| 5,497,609 | | 3/1996 | Lawrence | 57/400 |
| 5,651,244 | * | 7/1997 | Lucca et al. | 57/75 |
| 5,890,356 | * | 4/1999 | Stahlecker | 57/401 |

FOREIGN PATENT DOCUMENTS

| | | | |
|---|---|---|---|
| 44 26 278 | * | 2/1996 | (DE) . |
| 196 10 960 | | 9/1997 | (DE) . |
| WO 90 08211 | * | 7/1990 | (WO) . |

* cited by examiner

*Primary Examiner*—William Stryjewski
(74) *Attorney, Agent, or Firm*—Herbert Dubno

(57) ABSTRACT

Singled fibers from a fiber strand, separated by a rotor, are collected by suction on a continuously moving surface of a perforated belt or rotary drum. The fiber packet is not formed with a twist in this region and, only upon transfer to a downstream region is the twist applied, e.g. by a ring spindle.

15 Claims, 2 Drawing Sheets

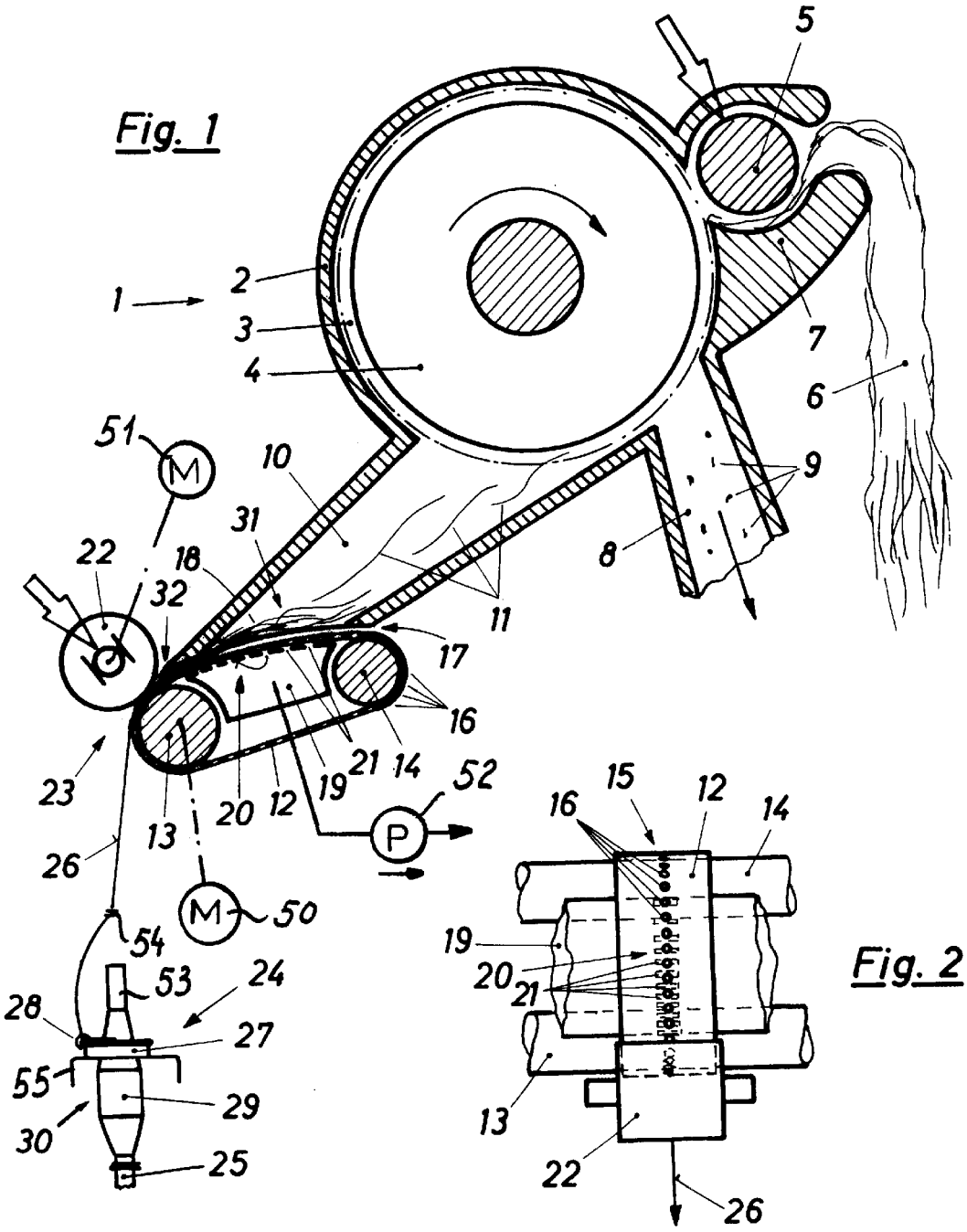
Fig. 1
1
2
3
4
5
6
7
8
9
10
11
12
13
14
15
16
17
18
19
20
21
22
23
24
25
26
27
28
29
30
31
32
50
51
52
53
54
55
M
P
Fig. 2
12
13
14
15
16
19
20
21
22
26
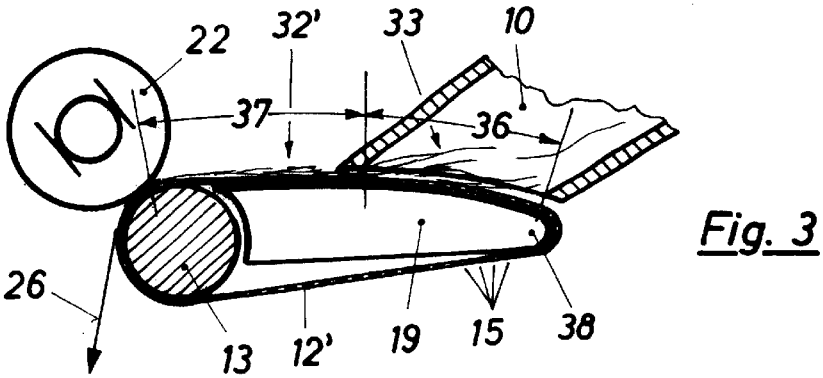
Fig. 3
10
12'
13
15
19
22
26
32'
33
36
37
38

5
2
1
4
7
6
10
36
31'
9
32
35
3
11
8
22
37
34
15'
33
23
26
16'
M
56

33
16'
15'
34
35
36
37
22
26

METHOD OF AND APPARATUS FOR PRODUCING A TEXTILE YARN

FIELD OF THE INVENTION

My present invention relates to a method of making a textile yarn and to an apparatus for that purpose. More particularly, the invention relates to a method in which, utilizing a separating or singling drum, roller or rotor, a fiber strand is separated into individual fibers and the individual fibers are drawn by suction onto a fiber collecting surface. Ultimately the collected fibers, in a continuous process, are twisted and thereby formed into a yarn in which the fibers have been rendered parallel and stretched out by virtue of the disintegration of the fiber strand and the singling of the fibers before they are collected. The term strand is here used to refer to a ribbon, band or strip of fibers which need not be fully parallel before they are subjected to individual separation from that band. The term "sliver" will be used herein to refer to a bundle of parallel and drawn out fibers prior to twisting and which may form a more or less dense yarn package or packet, densification reducing the cross section of the sliver.

BACKGROUND OF THE INVENTION

It is known from U.S. Pat. No. 5,497,609, for example, to produce a textile yarn by decomposing a bundle of fibers into individual fibers, i.e. singling the fibers, by means of a separating rotor or wheel, and then feeding the single fibers to a fiber collecting surface which is formed as a perforated trough. The perforations of the trough are connected with a suction source so that the individual fibers can be drawn into the trough. The result is a packet of parallel fibers which are consolidated by imparting a twist to them as they are drawn from the trough. As additional fibers accumulate at the end of a yarn as it is thus formed, a continuous spinning process is ensured for producing practically endless yarn.

The earlier system has been found to require the twisting of the fiber packet to enable it to be drawn from the trough. To produce the twist and to assist in drawing the yarn from the trough, counter travelling belts may be used and it has been found in practice that such systems are subject to a high degree of wear and can give rise to the variations in the twist and yarn withdrawal speeds because of difficulties in precisely establishing and controlling the belt speeds. It is also possible to provide the trough so that it feeds into the nip between two cooperating perforated rollers or drums which are driven in the same sense and which rotate about mutually parallel axes, or a system in which the trough is formed between two such perforated drums under suction.

When the fiber packet is moved over a stationary perforated surface or is displaced transversely to the fiber collecting surface and thus the fibers must be drawn over the perforations at which suction is maintained, there is a tendency for some of the fibers at least to be partially drawn into the perforations. Fibers which are trapped in such perforations can lose their parallelity and stretched out orientations, can be shifted in the yarn, can be bent into hairpin shape or can be given a corkscrew shape, all to the detriment of the yarn and the desired uniformity and reproducibility thereof.

OBJECTS OF THE INVENTION

It is the principal object of the present invention to provide an improved method of and an apparatus for making textile yarn, utilizing the principal of disintegration of a fiber strand into individual fibers, i.e. the singling of such fibers, whereby the drawbacks outlined above are obviated.

Another object of this invention is to provide a method of and an apparatus for the aforedescribed purpose which facilitates the transfer of the fiber packet from the fiber collecting surface. Another object of the invention is to provide a yarn making method and apparatus which will yield a yarn free from the corkscrew or hairpin bends hitherto encountered and, in general, a more reproducible and usable yarn.

SUMMARY OF THE INVENTION

These objects and others which will become more readily apparent hereinafter are attained, in accordance with the invention by collecting the singled fibers on the fiber collecting surface without a twist of the resulting fiber strand, transferring the resulting fiber packet from the collecting region to another region and, at the latter region, imparting a twist to the fiber packet.

As a consequence, the fiber packet and the fiber sliver are displaced from the region in which the fibers are deposited without a twist and the twist for consolidation of the fiber packet or the sliver is applied at a different location such that the fibers cannot be drawn into the perforations and thus be trapped there until hairpin or corkscrew bends are imparted to them. The separation of the twisting step from the collection step ensures that a highly uniform twist can be applied and that parallelity of the fibers will not be lost until the twisting stage is reached. The twisting can be effected in a limit of a ring spinning machine and, in practice, it is found that the ring spun yarn which is thus produced is highly uniform. Indeed, especially in the production of cross yarn with large fiber mass in cross section, with thick fiber packets and hence thick sliver, it has been found to be advantageous to subdivide the fiber collection surface into two zones, namely, an upstream zone in which the fibers are drawn with suction against the surface to form the fiber packet or sliver and a downstream zone in which the fiber sliver is reduced, i.e. the sliver is compacted without imparting a twist to the sliver at this stage.

In apparatus terms, the fiber collecting surface is provided as a closed continuously moving surface which is formed with a small strip of perforations riding over one or more suction openings of a suction duct. The surface may be formed by a belt or a rotating perforated drum and the perforations of the surface can register with the suction opening or suction openings. In either case a drive must be provided, i.e. for the belt or for the drum.

Since the fiber collection surface moves in an endless surface with the fiber packet thereon, the fibers of the packet do not shift relative to the perforations of the collecting surface and there is no danger that hairpin or corkscrew bends will be imparted to the fibers or that fiber dislocation will result because of relative movement of the collecting surface and the collected fiber packet.

The fiber packet or sliver is transported by the rotating perforated drum or endless perforated belt to the location at which the consolidating twist is to be applied and the suction retaining the sliver on the collecting surface can be reduced until the sliver is released to the twisting means, e.g. a ring spinning apparatus with spindle, traveler ring and the like. The twist is imparted to a yarn which is no longer in contact with the collecting surface and since the twist does not take place while the yarn is on the collecting surface there is no retardation of the twisting action induced by the collecting surface and an especially uniform twist can result. The use of the ring spindle for effecting the twist and winding up the yarn which results has been found to contribute to the production by the method of the invention of yarns which very closely resemble ring spinning yarns.

According to a first embodiment of the invention, the travelling surface can be the surface of an endless flexible belt which is past over at least one driven belt roll and is provided with a row of perforations. In a second embodiment the travelling surface can be formed by a driven hollow drum provided with the perforations. The driven belt roller or the drum can form with a counter roller a roller pair through the nip of which the sliver is passed. This affords the advantage that the withdrawal speed of the sliver can be precisely defined and extremely uniform, thereby ensuring a constant cross section and uniform twist per unit length of the yarn which is produced.

The device for separating the fiber strand into individual fibers, referred to herein as a separating, resolving or disintegrating unit, has an advantage over a drafting frame for a roving that the singling of the fibers enables their assembly into sliver which is equivalent to highly drafted sliver in terms of the parallelity of the fibers.

Foreign bodies that might be incorporated in the yarn by the inlet pair of rollers of a drafting frame cannot be incorporated and the irregular travel which characterizes slow speed drafting frames does not present a problem with respect to the uniformity of the product.

The belt can travel around a suction duct provided at one or more orifices, thereby allowing control of the degree of suction in accordance with the position of the collecting surface along the duct. There are units available which are provided with perforations, suction ducts, belts and the like which have been used in the past for so-called compaction spinning. The object in such cases is to reduce the cross section of a wide sliver delivered by the drafting frame so that it can be spun more readily. In the present case, the suction unit is not employed in conjunction with anything resembling a drafting frame. It has been found to be advantageous to pass the perforations over a suction duct which has, in a first zone, a relatively wide orifice or slit like orifices of greater length, and then over a portion of the orifice which progressively narrows or over slots of shorter length. The deposition of the individual fibers in the region of greater suction is thus ensured as is the progressive reduction in the cross section so that the fiber packet diminishes from a relatively wide initial fiber collection to a slender sliver. The density of the slits can increase in the direction of travel to ensure fully stretched out fibers in the fiber packet.

The method of the invention thus comprises the steps of:

(a) separating a fiber strand consisting of a multiplicity of textile fibers by feeding the fiber strand into contact with a fiber-separating rotor into individual fibers;

(b) drawing the individual fibers against a perforated fiber collecting surface by applying suction through perforations in the surface to continuously collect the individual fibers as parallel and drawn-out fibers into a sliver without twisting of the sliver on the surface;

(c) continuously advancing the untwisted sliver from the fiber collecting surface to another location; and (d) twisting the sliver at the other location to consolidate the sliver into a yarn.

Preferably in step (b):

($b_1$) the collected individual fibers are assembled into a fiber package on an upstream zone of the surface; and ($b_2$) the fiber package is reduced in cross section at a downstream zone of the surface.

The apparatus can comprise:

means including a fiber-separating rotor for separating a fiber strand consisting of a multiplicity of textile fibers into individual fibers;

an endless traveling perforated fiber collecting surface having a narrow strip of perforations traveling over at least one suction opening in a collecting region for continuously collecting the individual fibers as parallel and drawn-out fibers on the surface into a sliver without twisting of the sliver on the surface;

means for driving the surface and continuously advancing the untwisted sliver from the collecting region to another location; and means at the other location for twisting the sliver to consolidate the sliver into a yarn.

BRIEF DESCRIPTION OF THE DRAWING

The above and other objects, features, and advantages will become more readily apparent from the following description, reference being made to the accompanying drawing in which:

FIG. 1 is a cross sectional view illustrating a first embodiment of the yarn making unit of the invention in which the collecting surface is formed by a belt;

FIG. 2 is a plan view of the fiber collecting surface of FIG. 1;

FIG. 3 is a cross section through a modification of the embodiment of FIGS. 1 and 2;

SPECIFIC DESCRIPTION

Figure 4:
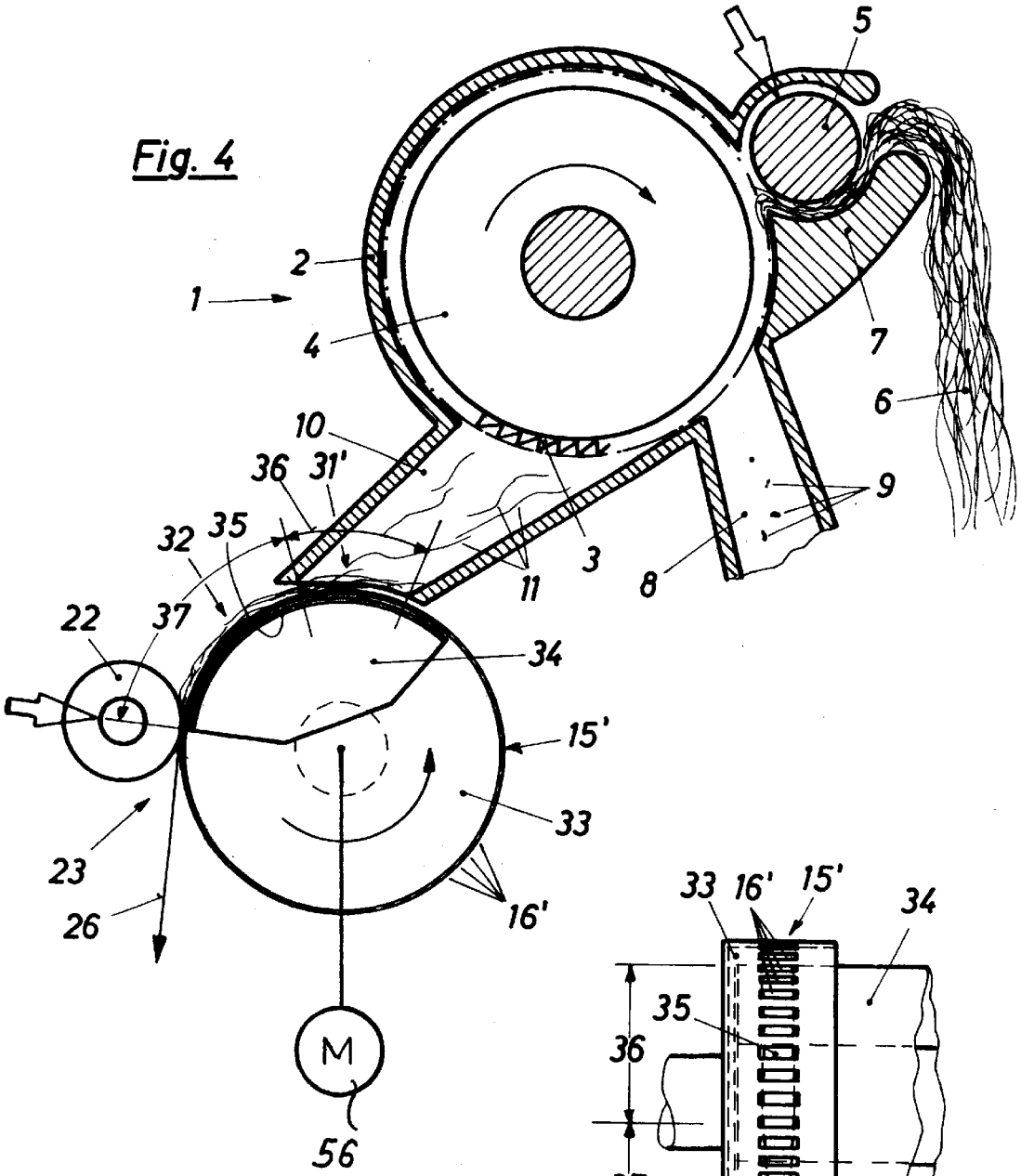
FIG. 4 is a section through a second embodiment in which the travelling collecting surface is formed by a rotating drum.

The spinning system of the invention, operating with a fiber strand 6, initially disintegrates the fiber strand into individual fibers, i.e. comprises a singling unit represented at 1. The singling units of FIGS. 1 and 4, for an open end spinning machine, is comprised of housing 2 in which a separating rotor 4 rotates at high speed in the direction of the arrow. The rotor 4 is provided with a sawtooth clothing 3 which effects separation of the fiber strand into the individual fibers 11.

The fiber strand is fed by a feed roller 5 driven in the same sense to advance the fiber strand 6 via a feed trough 7 to the sawtooth structure 3 on the rotor 4. From the housing 2, a waste passage 8 is branched from which foreign material represented at 9, i.e. pieces of material which are not textile fibers, can be discharged centrifugally. In the sense of rotation of the rotor 4 beyond the waste-discharge branch 8, the fiber passage 10 is provided in the housing and delivers the individual fibers or singled fibers to the discharge end of that passage.

In the embodiment of FIGS. 1–3, this fiber passage 10 opens onto an endless flexible belt 12 forming the fiber collecting surface (FIGS. 1 and 2), the belt being guided over two belt rollers 13 and 14 at least one of which is driven by a drive means represented by the motor 50. Alternatively, the pressing or counter rolling 22 can be driven by a motor 51 and can fictionally entrain the belt 12 by directing contact with it and the yarn thereon. The belt 12 is formed in its middle with a narrow row of perforations 15 (see FIG. 2) in the form of small round holes. The perforations, however, can have other shapes, for example, oval or approximately rectangle holes.

The upper pass 17 of the belt 12, which is turned toward the mouth of the fiber passage 10, travels over the convexly curved upper surface 18 of a suction passage 19 lying within the belt between the belt rollers 13 and 14 and which is connected to a suction source 52. The surface 18 is provided with a perforation 20 which can be composed, as shown in FIG. 2, of a row of slits 21 transverse to the direction of movement of the belt. The slits 21 are elongated axially of the rollers 13 and 14 so that they communicate with the holes 16 even in the case of a lateral shift of the belt to one side or the other of the intermediate position shown in FIG. 2. The length of the region in which the perforations 15 and 20 overlap corresponds approximately to the staple length of the fibers handled.

At the discharge end of the belt 12, juxtaposed with the belt roller 13 is the pressure roller 22 which forms a roll pair 23 with the belt roller 13. This roll pair 23 is followed by a ring spinning spindle 24 of a type conventional in a ring spinning machine and here shown to a smaller scale simply for purposes of illustration. The ring spindle 24 comprises a spindle 25 carrying a core or sleeve 53 on which the yarn is wound in turns 29 to form a bobbin 30. For this purpose, the yarn 26 is guided through an eye 54 to a traveler 28 running along the traveller ring 27 on a ring rail 55 which is movable up and down to distribute the windings 29 along the bobbin 30. In FIG. 3, the belt 12' is guided over roller 13 and a deflective rail 38.

Figure 5:
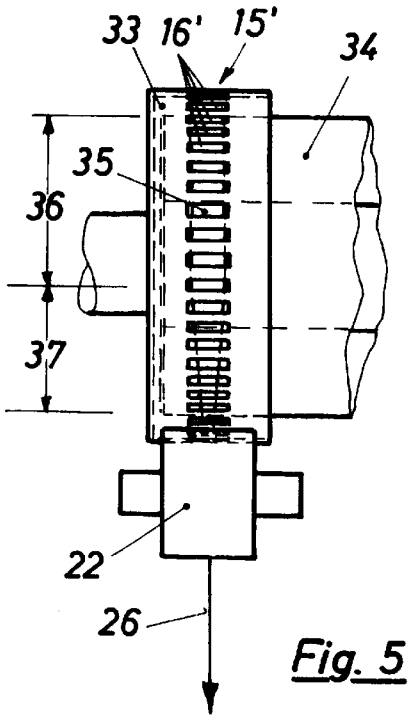
FIG. 5 is a plan view of the fiber collecting surface of FIG. 4.

In operation, single fibers 11 which are separated from the fiber strand 6 by the rotor 4 are drawn by the suction applied from the source 52 via the perforations 15 and 20 onto the belt 12. The fibers 11 accumulate to a fiber packet 31 which, during the travel of the belt, is fed past the roller pair 23 to the ring spindle 24. Only at this point is a twist applied to the sliver. Because of the continuous feed of the fibers 11 and the simultaneous withdrawal of the fiber packet 31, the fibers accumulate in a mutually parallel but overlapping relationship to an endless sliver 32. The spindle 24 generates a twist in the sliver before it is wound as a yarn on the bobbin 30. In the embodiment of FIGS. 4 and 5, the fiber passage 10 opens onto the surface of a drum 33 which is provided with perforations 15' in the form of slits 16' parallel to the axis of rotation of the drum. The latter is driven by the rotor 56.

The drum 33 is here shaped as a cup which at its open side communicates with a suction duct 34, the latter extending into the cup. The suction duct 34 has in the region of the perforations 15' a single opening 35 communicating with the slits 16' and converging away from the region at which the fibers are originally collected.

The path of the drum is thus subdivided into an upstream zone 36 and a downstream zone 37. The drum is masked by the duct 34 except where slits 16' communicate with the opening 35.

As in the embodiment of FIG. 1, the drum can cooperate with a pressure roller 22 forming a roller pair 23' with the drum. The spindle 24 already described in connection with FIG. 1 is provided here to impart a twist to the yarn 26. In the operation of the apparatus of FIG. 4, the singled fiber 11 pass through the fiber passage 10 onto the drum 33 and are drawn thereagainst by the suction applied through the perforations 15' and 35'.

In region 36, because of the slit shape of the perforations 16', a comparatively wide fiber packet 31' is formed. When the slits 16' of the perforation 15' of drum 33 communicate with the opening 35 over the region 37 in which the opening converges, the fiber packet 31' is progressively compacted or compressed into a slender fiber sliver 32. The fiber sliver 32 is delivered by the roller pair 23' to the spindle 24 which causes a twist in the yarn 26 and allows the yarn to be wound up in a bobbin.

The sliver forming zone in the embodiment of FIGS. 4 and 5 is thus the first region in which a broad packet 31' is generated and in the subsequent region 37 the broad fiber packet is narrowed to a slender fiber sliver. This subdivision of the sliver forming zone into a collection region 36 and a compaction region 37 has been found to be especially advantageous with thick fiber having many fibers in the cross section.

This subdivision of the sliver forming zone into a collection region 36 and a compaction region 37 is also possible in the embodiments of FIGS. 1–3. As can be seen from FIG. 3, the belt 12' is elongated so that it stretches over the two regions 36 and 37. The perforations 15 of the belt 12' can be multiple rows of holes 16 or slits adjacent one another as in the drum 33 of FIGS. 4 and 5 and the length of the slits 21 of the perforation 15 of the suction duct 10 can be reduced generally in the travel direction of the belt 12 to effect a constriction of the fiber sliver 32'.

It is naturally also possible in the embodiment of FIGS. 4 and 5 to eliminate this subdivision of the sliver forming zone and operate with only a single deposition region 36 to form the fiber packet and the fiber sliver.

FIG. 3 also shows that the deflection effect of the belt roller 14 of FIGS. 1 and 2 can also be replaced by a rounded edge of the suction duct 19. It is also seen from FIG. 3 that the density of the perforations 20 of the suction duct, namely, the spacing of the slits 21, can be progressively reduced in the direction of travel of the sliver 32. In these regions, a greater suction force is generated to densifying the fiber packet.

It has not been shown that the fiber packet and the fiber sliver can cooperate with a downwardly turned fiber collecting surface so that the fibers are drawn from below onto the latter. This has the advantage of a more natural delivery to the fiber collecting surface and a reduced structural height of the apparatus.

I claim:

1. A method of making a twisted textile yarn comprising the steps of:

(a) separating a fiber strand consisting of a multiplicity of textile fibers by feeding said fiber strand into contact with a fiber-separating rotor into individual fibers;

(b) drawing said individual fibers against a perforated fiber collecting surface by applying suction through perforations in said surface to continuously collect the individual fibers as parallel and drawn-out fibers into a sliver without twisting of said sliver on said surface, and in which:

($b_1$) the collected individual fibers are assembled into a fiber package on an upstream zone of said surface, and ($b_2$) the fiber package is reduced in cross section at a downstream zone of said surface;

(c) continuously advancing the untwisted sliver from said fiber collecting surface to another location; and (d) twisting with a ring spinning apparatus the sliver at said other location to consolidate said sliver into a yarn so that twist is imparted to said sliver initially at said other location.

2. An apparatus for making a twisted textile yarn comprising:

means including a fiber-separating rotor for separating a fiber strand consisting of a multiplicity of textile fibers into individual fibers;

an endless traveling perforated fiber collecting surface having a narrow strip of perforations traveling over at least one suction opening in a collecting region for continuously collecting the individual fibers as parallel and drawn-out fibers on said surface into a sliver without twisting of said sliver on said surface and for compacting said sliver on said surface;

means for driving said surface and continuously advancing the untwisted sliver from said collecting region to another location; and means at said other location for twisting with a ring spinning apparatus the sliver to consolidate said sliver into a yarn so that twist is imparted to said sliver initially at said other location.

3. The apparatus defined in claim 2 wherein said endless traveling perforated fiber collecting surface is formed by flexible belt passing around at least one driven roller.

4. The apparatus defined in claim 3, further comprising a counter-roller pressing against said surface in a region of said driven roller.

5. The apparatus defined in claim 3 wherein said suction opening is formed in a suction duct and said duct is convexly curved where said belt travels over said duct.

6. The apparatus defined in claim 3 wherein said belt passes around two belt rollers.

7. The apparatus defined in claim 3 wherein said belt passes around one belt roller and a deflecting rail.

8. The apparatus defined in claim 3 wherein said suction opening is formed in a suction duct around which said belt is guided, said suction duct being formed with a deflection edge about which said belt changes direction.

9. The apparatus defined in claim 2 wherein said endless traveling perforated fiber collecting surface is formed by a driven hollow drum.

10. The apparatus defined in claim 9, further comprising a counter-roller pressing against said drum.

11. An apparatus for making a twisted textile yarn comprising:

means including a fiber-separating rotor for separating a fiber strand consisting of a multiplicity of textile fibers into individual fibers;

an endless traveling perforated fiber collecting surface having a narrow strip of perforations traveling over at least one suction opening in a collecting region for continuously collecting the individual fibers as parallel and drawn-out fibers on said surface into a sliver without twisting of said sliver on said surface and for compacting said sliver on said surface;

means for driving said surface and continuously advancing the untwisted sliver from said collecting region to another location; and means at said other location for twisting the sliver to consolidate said sliver into a yarn so that twist is imparted to said sliver initially at said other location, said surface passing over a suction duct formed with a multiplicity of suction openings adapted to communicate with said perforations.

12. The apparatus defined in claim 11, wherein said suction openings are slits.

13. The apparatus defined in claim 12 wherein a density of said openings increases in a travel direction of said surface.

14. The apparatus defined in claim 13 wherein said slits are relatively longer close to where said fibers deposit on the surface and are progressively shorter in said travel direction.

15. An apparatus for making a twisted textile yarn comprising:

means including a fiber-separating rotor for separating a fiber strand consisting of a multiplicity of textile fibers into individual fibers;

an endless traveling perforated fiber collecting surface having a narrow strip of perforations traveling over at least one suction opening in a collecting region for continuously collecting the individual fibers as parallel and drawn-out fibers on said surface into a sliver without twisting of said sliver on said surface and for compacting said sliver on said surface;

means for driving said surface and continuously advancing the untwisted sliver from said collecting region to another location; and means at said other location for twisting the sliver to consolidate said sliver into a yarn so that twist is imparted to said sliver initially at said other location, said surface passing over a suction duct formed with a suction opening adapted to communicate with said perforations and having a width which is greater close to where said fibers deposit on the surface and narrowing in a travel direction of said surface to a region of compaction of the sliver.

* * * * *